US005413244A

United States Patent [19]

Ramsey

[11] Patent Number: 5,413,244

[45] Date of Patent: May 9, 1995

[54] OPEN-TOPPED CAN BODY WITH PANELLED SIDE WALLS

[75] Inventor: Christopher P. Ramsey, Uffington, United Kingdom

[73] Assignee: Carnaudmetalbox plc, United Kingdom

[21] Appl. No.: 237,724

[22] Filed: May 4, 1994

Related U.S. Application Data

[63] Continuation of Ser. No. 51,658, Apr. 26, 1993, abandoned.

[30] Foreign Application Priority Data

Apr. 25, 1992 [GB] United Kingdom ..... 9208984

[51] Int. Cl.[6] ..... B65D 8/12

[52] U.S. Cl. ..... 220/671; 220/755; 220/907

[58] Field of Search ..... 220/906, 907, 669, 670, 220/671, 674, 755, 770, 771, 675; 138/121, 173; 215/100 A, 1 C; D9/551, 556, 506, 564, 569

[56] References Cited

U.S. PATENT DOCUMENTS

| | | | |
|---|---|---|---|
| 27,381 | 7/1897 | Pendelton, Jr. . | |
| 40,138 | 7/1909 | Schramm . | |
| D. 84,839 | 8/1931 | McDonough | D9/556 |
| 99,407 | 8/1935 | McManus . | |
| 201,400 | 6/1965 | Kneeland . | |
| 209,714 | 12/1967 | Evans . | |
| 254,714 | 4/1980 | Mascia . | |
| 290,688 | 7/1987 | Moloney et al. . | |
| 1,083,311 | 1/1914 | Weber | 220/674 |
| 1,378,442 | 5/1921 | Chalfant . | |
| 1,454,802 | 5/1923 | Wells . | |
| 2,063,013 | 9/1934 | Cooper . | |
| 2,894,844 | 7/1959 | Shakman | 220/906 |
| 2,974,824 | 3/1961 | Mansho . | |
| 4,169,537 | 10/1979 | Sabreen et al. . | |
| 4,723,681 | 2/1988 | Glerum . | |
| 4,993,565 | 2/1991 | Ota et al. | 215/1 C |
| 5,040,698 | 8/1991 | Ramsey et al. . | |
| 5,092,475 | 3/1992 | Krishnakumar et al. | 215/1 C |
| 5,141,120 | 8/1992 | Brown et al. | 215/1 C |
| 5,141,121 | 8/1992 | Brown et al. | 215/100 A |
| 5,178,289 | 1/1993 | Krishnakumar et al. | 215/1 C |
| 5,279,433 | 1/1994 | Krishnakumer et al. | 215/1 C |
| 5,303,834 | 4/1994 | Krishnakumar et al. | 215/1 C |

FOREIGN PATENT DOCUMENTS

| | | | |
|---|---|---|---|
| 0097399 | 6/1983 | European Pat. Off. . | |
| 0505054 | 3/1992 | European Pat. Off. . | |
| 6354611 | 9/1986 | Japan . | |
| 703836 | 12/1949 | United Kingdom . | |
| 889981 | 3/1959 | United Kingdom . | |
| 1120576 | 7/1966 | United Kingdom . | |
| 2237550 | 5/1991 | United Kingdom | 220/669 |

OTHER PUBLICATIONS

Modern Packaging, Continental Can Co. Ad., Oct. 1968, Back Cover–Outside.
Galvanised Dustbin "1985".
Minature Dustbin "1985" Gloucester, UK
Dutsbin "1975" Reading, UK.

*Primary Examiner*—Stephen J. Castellano
*Attorney, Agent, or Firm*—Diller, Ramik & Wight

[57] ABSTRACT

A sheet metal can body 1 comprises an end wall 2 and a tubular side wall 3 which includes a plurality of flexible panels 4 recessed within the cylindrical envelope of the side wall and extending between plain cylindrical end portions 5 of the side wall. Each panel 4 is formed of a plurality of flutes 6 defined laterally on each side by a convex rib 7.

25 Claims, 7 Drawing Sheets

OPEN-TOPPED CAN BODY WITH PANELLED SIDE WALLS

This application is a continuation of application No. 08/051,658, filed Apr. 26, 1993, now abandoned.

BACKGROUND OF THE INVENTION

The invention relates to sheet metal can bodies such as are used to contain processed foods or beverages.

GB 2 237 550 describes a can body in which the side wall includes a plurality of adjacent panels in the form of single concave flutes. Each flute is defined laterally on each side by a convex rib lying on the cylindrical envelope of the side wall. The panels tend to flex in groups when the can body is subject to an internal pressure reduction and return to their relaxed position when the pressure reduction is relieved.

The present invention relates to a modification of the can body of GB 2 237 550 which has particular application where an internal pressure reduction is maintained in a can body after processing of the food or beverage therein is complete and the can has returned to ambient temperature. This occurs for example in the case of hot filling of eg fruit juices. Pressure reduction after processing may also be obtained as a result of the can volume increasing during processing due to a high internal pressure causing expansion of the can ends and side wall.

A prior solution to the problem of residual internal pressure reduction in can bodies is described in U.S. Pat. No. 4,836,398. In this solution the bottom wall of the can body is reformed after filling and sealing to increase the internal pressure. This requires the provision of a specially formed bottom wall and adds an additional step to the process of filling cans.

SUMMARY OF THE INVENTION

In the present invention a can body is provided in which large flexible panels are formed by groups of concave flutes. These panels can flex to reduce or increase the internal volume of the can body when it is subjected to an internal pressure reduction or increase.

According to the present invention there is provided a sheet metal can body comprising an end wall and a tubular side wall upstanding from the periphery of the end wall, the side wall being formed from a plain cylinder defining a cylindrical envelope of the side wall; wherein the tubular side wall includes a plurality of flexible panels recessed within the cylindrical envelope of the side wall and each of which extends generally parallel to the central axis of the side wall and is connected at each of its ends to a cylindrical portion of the side wall; wherein each panel is formed of a plurality of elongate concave flutes extending generally parallel to the central axis of the side wall, each flute being defined laterally on each side by a convex rib; wherein the outermost convex ribs of each panel lie on the cylindrical envelope of the side wall of the can and, at least in the longitudinal middle region of the panels, the remaining convex ribs of each panel lie inside the cylindrical envelope of the side wall; and wherein the perimeter and envelope of the side wall are substantially constant along the entire length of the side wall.

Preferably, the remaining convex ribs of each panel lie substantially on a chord of the cylindrical envelope of the side wall.

By forming the panels with a plurality of flutes such that, at least in the middle region, the ribs of the flutes lie on or near a chord of the cylindrical envelope of the can body, it is possible to form large panels without stretching the material of the can body which do not greatly reduce the volume of the can in the relaxed state but which can readily flex inwardly or outwardly to accommodate pressure differentials. Considering a cross-section through the can body through its longitudinal mid-portion, it can be seen that the material of the can in the panels has been moved from the cylindrical envelope to lie generally on a chord of the cylindrical envelope. By providing each panel with a plurality of concave flutes, this is achieved without change to the perimeter length of the can body. Moreover, the resultant panels are very flexible.

The side wall of the can body of the present invention is formed from a plain cylinder without stretching of the material thereof. When subjected to an internal overpressure or underpressure the panels flex to change the internal volume of the can body. In both cases an increase in the strength and abuse resistance of the can body has been found to occur. Whilst an increase in strength and abuse resistance is normal when an internal overpressure is provided in a can body, this is not the case where an internal underpressure exists and many steps have been taken in the past to avoid or remove any underpressure in can bodies after processing. The can body of the present invention is thus particularly useful in applications where an underpressure may exist in the can body after processing.

Embodiments of the invention are described below with reference to the accompanying drawings in which:

DESCRIPTION OF THE PREFERRED EMBODIMENTS

Figure 2:
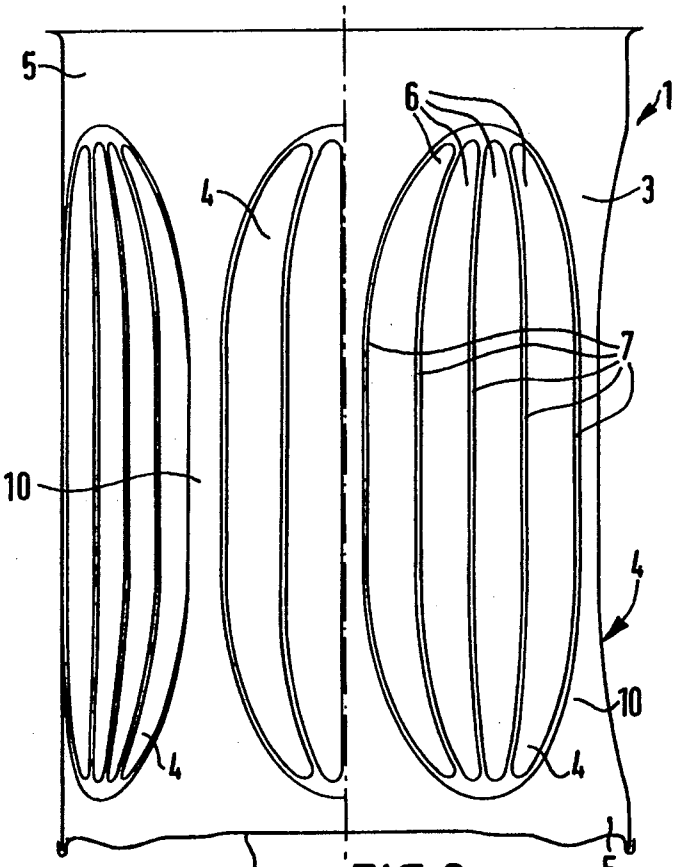
FIG. 2 is a vertical section through the can body of FIG. 1 on the line II—II on FIG. 3.
Figure 1:
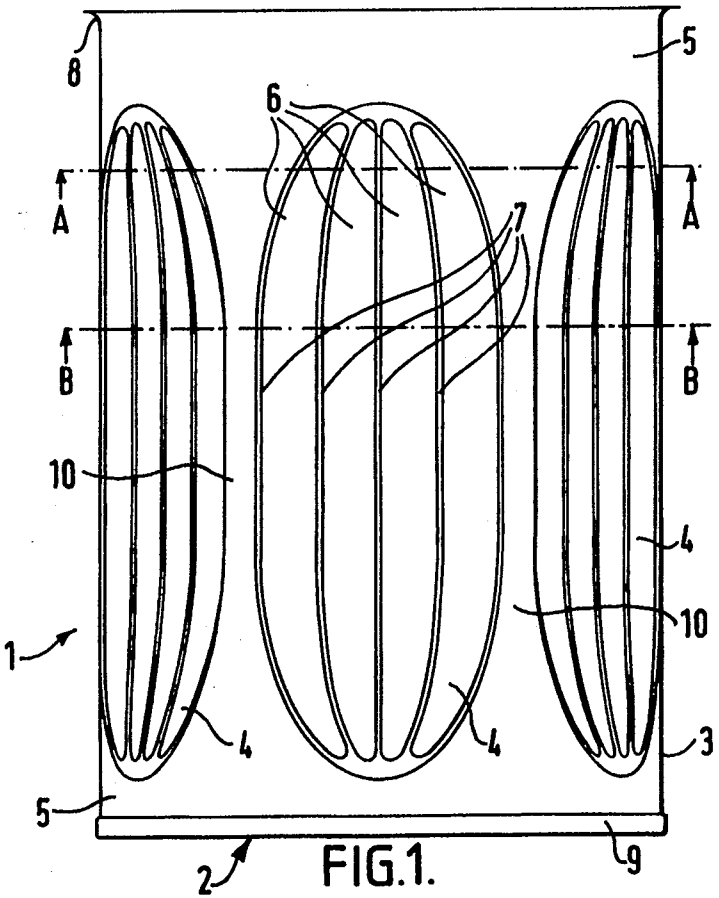
FIG. 1 is a side view of a can body.

The can body 1 shown in FIGS. 1 to 5 has a bottom end wall 2 and a tubular side wall 3. The side wall is formed in known manner from a rectangular sheet of metal formed into a plain cylinder and seam welded in known manner. This plain cylinder defines the cylindrical envelope of the side wall. The ends of the cylinder are then flanged and a can end connected by a seam 9 to one end of the side wall to provide a bottom end wall. It will be understood that a further can end will be seamed to the top flange 8 after filling of the can body to form a closed three-piece can.

A plurality of longitudinal panels 4 are formed in the side wall 3 and are recessed within the cylindrical envelope of the side wall. The panels extend in length generally parallel to the axis of the side wall and are connected at each end to a cylindrical end portion 5 of the side wall. The cylindrical end portions 5, being unreformed portions of the plain cylinder, lie on the cylindrical envelope of the side wall.

Each panel 4 is formed of a plurality of elongate concave flutes 6 defined laterally on either side by a convex rib 7. In the embodiment of FIGS. 1 to 5 the ribs 7 merge together at the ends of the panels 4 to give the ends of the panels a substantially elliptical outline. The axial profiles of the panels 4 can be best seen on the right hand side of FIG. 2. Here it can be seen that the axial profiles curve inwardly from the cylindrical envelope of the side wall at the top and bottom ends of the panels whilst the axial profile of the panels in their longitudinal middle region is flat.

Figure 3:
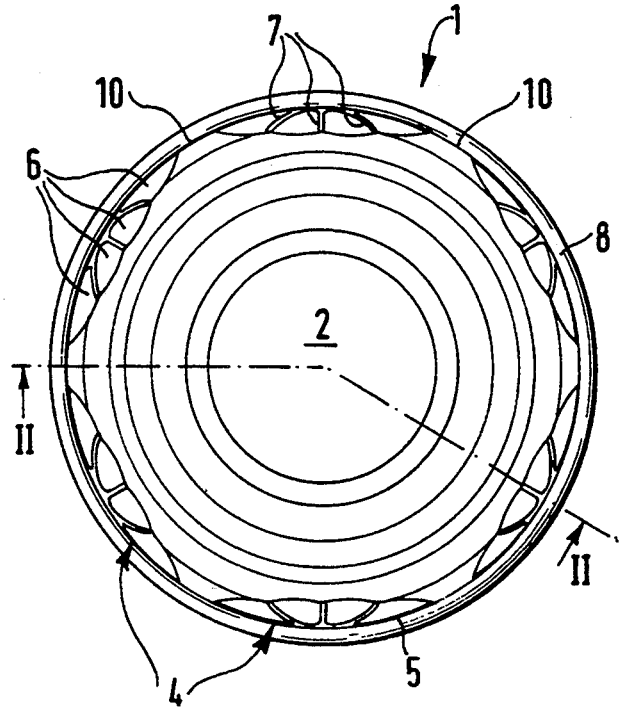
FIG. 3 is a plan view of the can body of FIG. 1.
Figure 4:
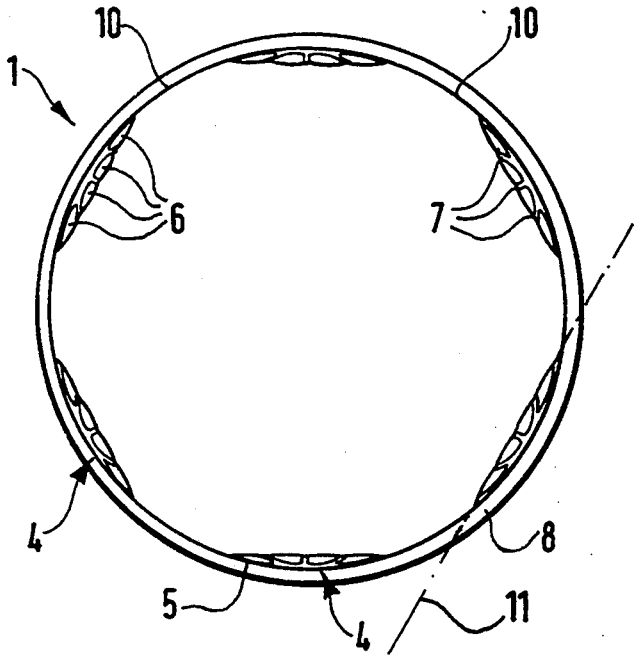
FIG. 4 is a horizontal section on the line A—A of FIG. 1.
Figure 5:
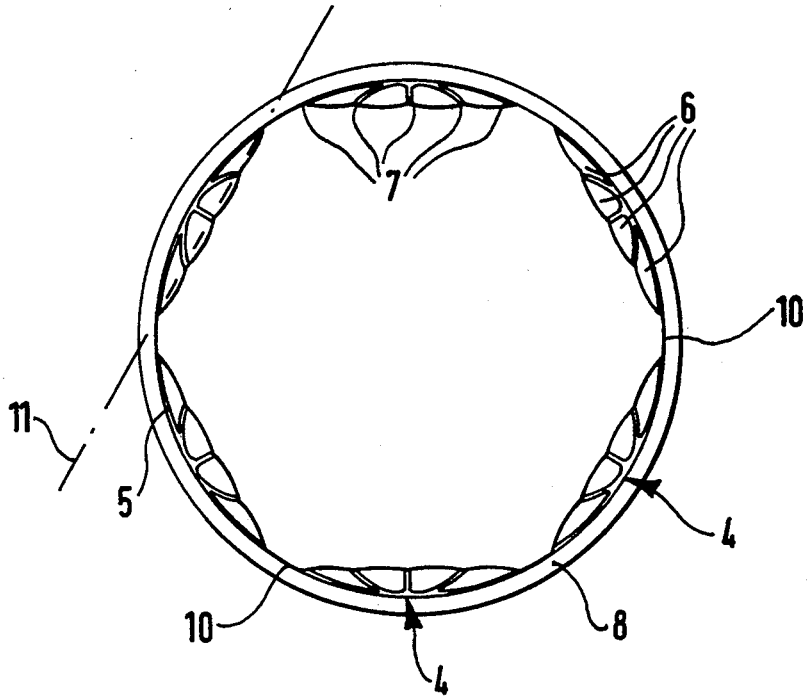
FIG. 5 is a horizontal section on the line B—B of FIG. 1.
Figure 7:
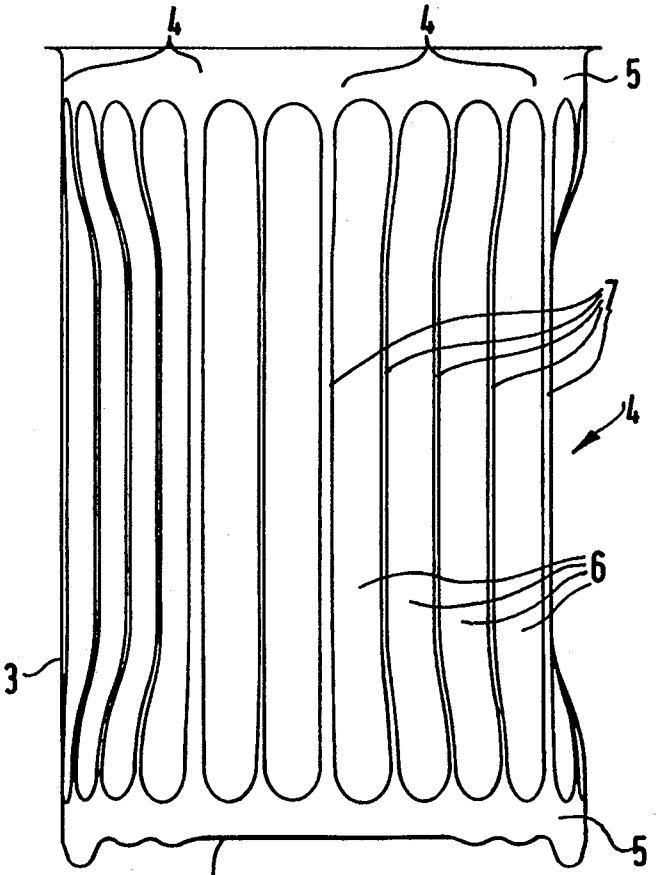
FIG. 7 is a vertical section through the can body of FIG. 6 on the line VII—VII on FIG. 8.
Figure 6:
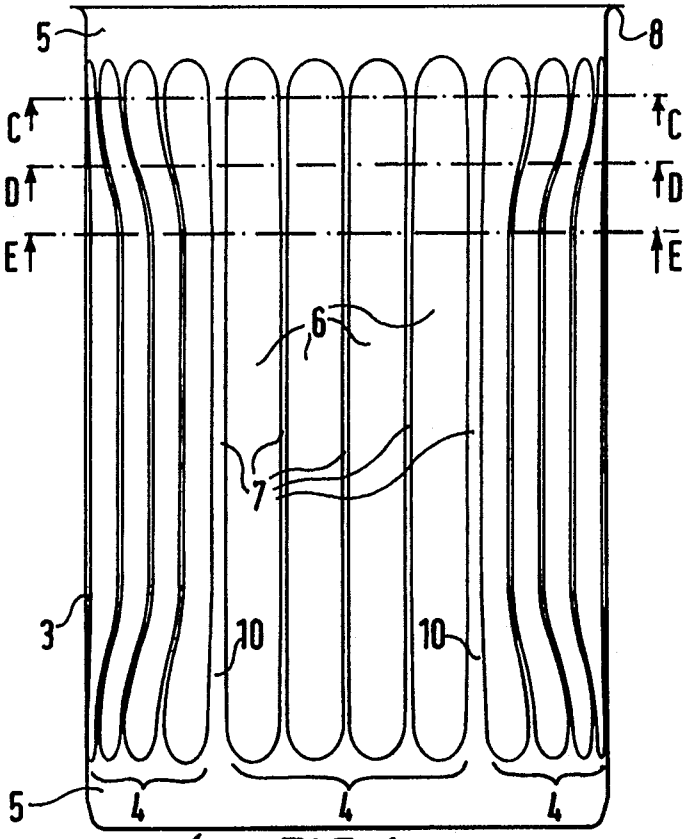
FIG. 6 is a side view of another can body.
Figure 8:
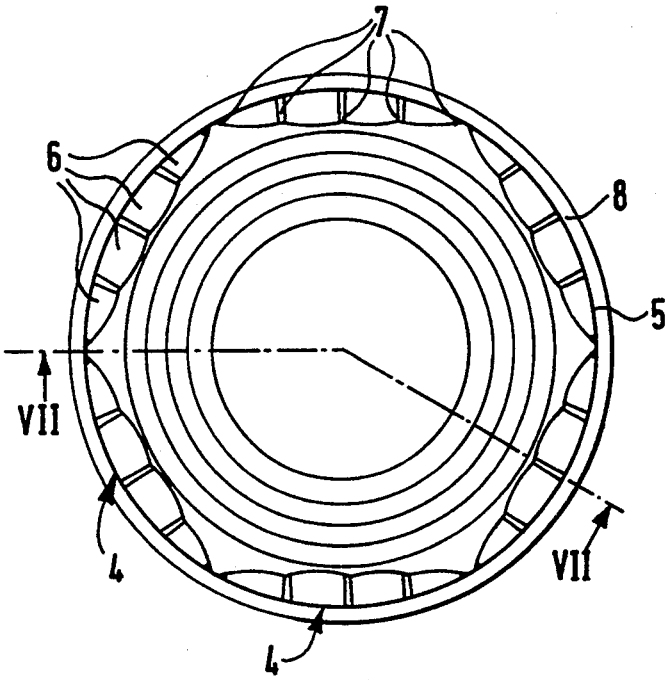
FIG. 8 is a plan view of the can body of FIG. 6.
Figure 9:
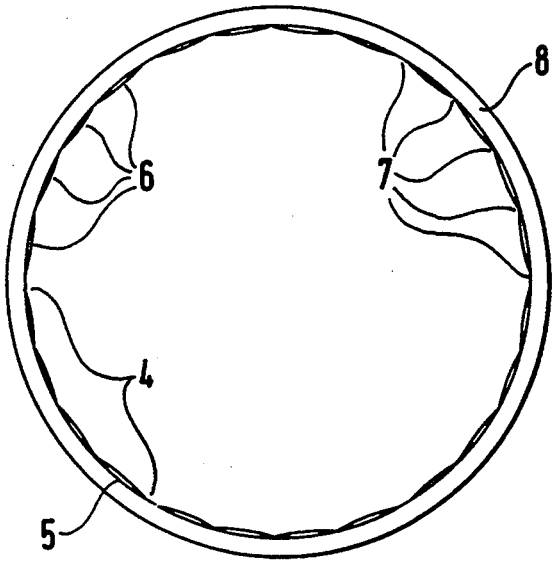
FIG. 9 is a horizontal section on the line C—C of FIG. 6.
Figure 10:
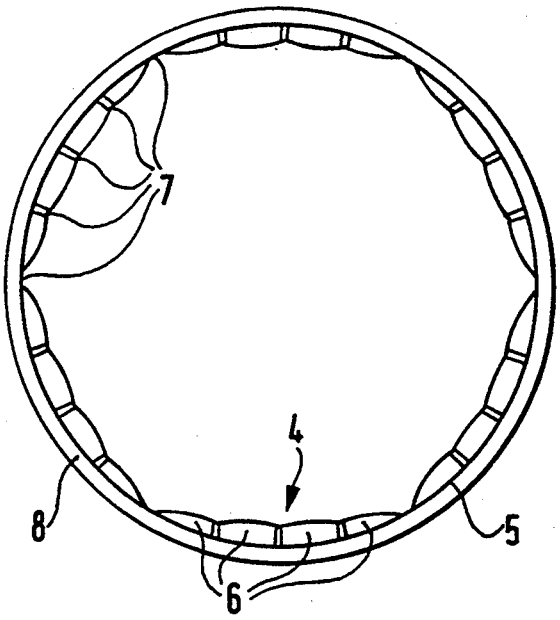
FIG. 10 is a horizontal section on the line D—D of FIG. 6.
Figure 11:
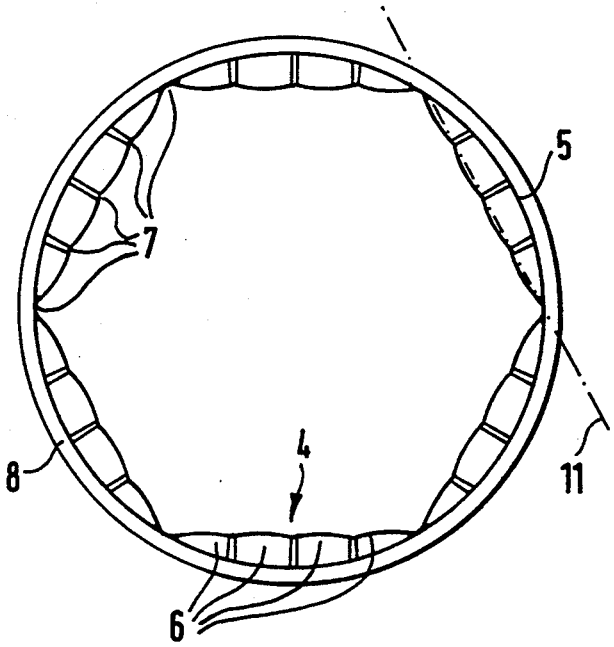
FIG. 11 is a horizontal section on the line E—E of FIG. 6.

The circumferential profiles of the panels are best seen in FIGS. 3 to 5. As indicated in FIGS. 4 and 5 the ribs 7 of the flutes 6 lie on a chord 11 of the cylindrical envelope of the side wall. In the embodiment of FIGS. 1 to 5 the panels are spaced from one another by a part cylindrical wall portion 10 connecting the cylindrical end portions 5 and lying on the cylindrical envelope of the side wall. In another embodiment, not shown, these wall portions 10 are absent and the panels are contiguous in their longitudinal middle regions. In this case the outer ribs 7 of adjacent panels will merge. In either case, it will be seen that the outer ribs of each panel lie on the cylindrical envelope of the side wall. It is preferred for the panels, at their greatest width, to occupy at least 70% of the circumference of the can body. The panels are preferably identical to one another and spaced equally if spaced at all.

The ribs have a slight circumferential extent and are substantially flat or slightly convex in circumferential profile. It is preferred for the flutes, at their greatest width, to occupy at least 70% of the circumferential extent of each panel.

FIGS. 6 to 11 show a one piece can body 1 for forming a two piece can when a can end is seamed onto the flange 8. The can body is formed from a blank by a drawing and wall ironing process which is well known, or by drawing and re-drawing. Again the can body is formed initially with a plain cylindrical side wall which defines the cylindrical envelope of the side wall 3. The bottom wall 2 is integrally connected to the side wall 3 in this embodiment.

The panels 4 in this embodiment each comprise four flutes 6 but in this case the ribs do not merge at the ends of the panels to provide the panels with an end profile. As can be seen from FIGS. 8 to 11, the ribs 7 of the flutes only lie on a chord 11 of the cylindrical envelope in the longitudinal middle region of the panels.

Figure 12:
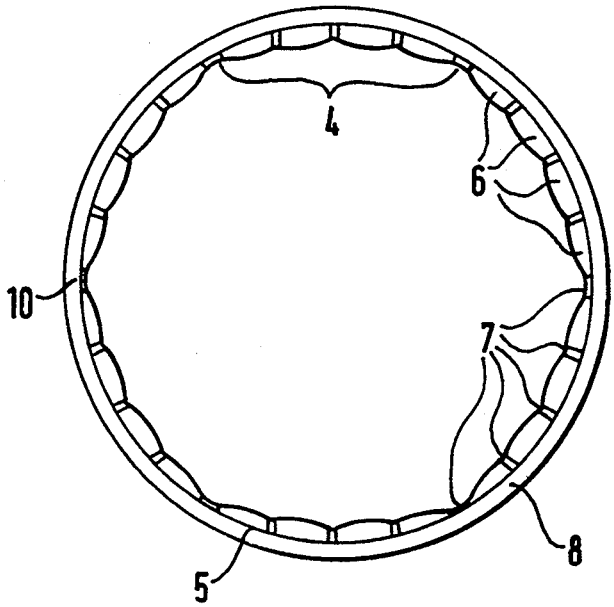
FIG. 12 is a horizontal section through the can body on the line E—E of FIG. 6 when the can body is subject to an increased internal pressure.
Figure 13:
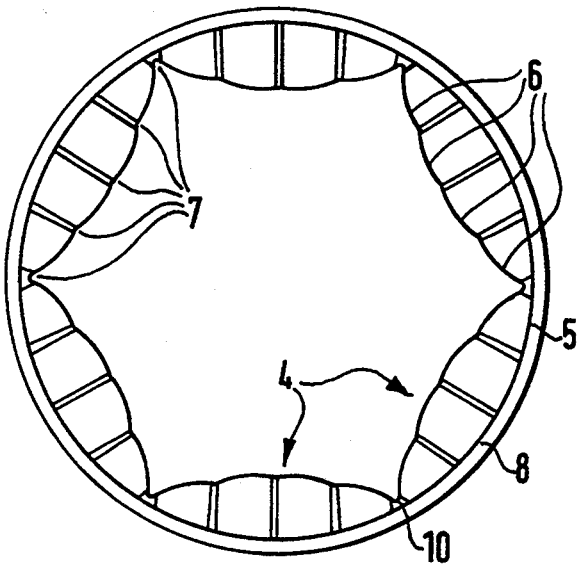
FIG. 13 is a horizontal section through the can body on the line E—E of FIG. 6 when the can body is subject to an internal pressure reduction.

FIGS. 12 and 13 show respectively the effect of increased and reduced pressure within the can body when closed by a lid (upper can end). As can be seen in FIG. 13, the panels flex inwardly under a reduced internal pressure to reduce the volume of the can body. This flexing of the panels is provided by the elastic bending of the flutes. In this embodiment the part cylindrical portions 10 have a very small circumferential dimension and are formed by the merging of the outside ribs 7 of adjacent panels. As can be seen from FIGS. 12 and 13 these merged ribs 10 fold and move slightly inwardly of the cylindrical envelope of the side wall when the can body is subjected to an increased or a reduced internal pressure. The folding of the merged ribs provides a hinge mechanism for the flexing of the can body. It should be understood that the embodiment of FIGS. 1 to 5 will flex in a similar manner when subjected to an internal pressure reduction.

Experiments have shown that the strength and abuse resistance of can bodies as described herein are increased both when the can is subjected to an internal overpressure and when it is subjected to an internal reduction in pressure.

The embodiments shown are provided with six panels each consisting of four flutes. In other embodiments, not shown, the number of panels may vary within the range from four to twelve and the number of flutes in each panel may vary from two to eight. Different numbers of panels and flutes will suit can bodies of different sizes and subjected to different conditions.

The side walls of the can bodies of the present invention are formed from plain cylindrical side walls by folding without stretching of the metal. To achieve this the profiles of the panels are designed such that the perimeter of the can body is constant along the entire length of the side wall and equal to the perimeter of the unre-formed cylindrical portions. Since the ribs 7 of the flutes 6 are designed to lie on a chord of the cylindrical envelope, the volume of the can body lost by the provision of the panels is much less than if concave panels without flutes were provided. This also makes possible the provision of large flexible panels without axial stretching of the metal of the side wall during formation of the panels.

In a further embodiment, not shown, two sets of panels are provided one above the other and separated by a central cylindrical portion of side wall. This arrangement is particularly suited to applications where a relatively tall can body is used such as in the case of can bodies for aerosols.

Whilst the articles as described have been primarily designed for processed food or beverage products, the ability of such a container to withstand a high internal vacuum makes this invention also suitable for other vacuum filled containers such as for aerosols, or dry powders/particulates, or other hot filled products such as oils, or other viscous products.

Although a preferred embodiment of the invention has been specifically illustrated and described herein, it is to be understood that minor variations may be made in the apparatus without departing from the spirit and scope of the invention, as defined the appended claims.

What is claimed is:

1. An open-topped sheet metal can body comprising an end wall and a tubular side wall upstanding from a periphery of the end wall, the side wall being formed from a plain cylinder defining a cylindrical envelope of the side wall;

said side wall terminating in an open top remote from said end wall;

said tubular side wall includes a plurality of flexible panels recessed within the cylindrical envelope of the side wall, all said panels being substantially equally spaced from each other in all circumferential directions around said side wall, each of said panels having a central longitudinal axis which extends in a direction generally parallel to an axis central to the cylindrical envelope of the side wall, each panel being connected at each of panel ends thereof to a cylindrical portion of the side wall;

each panel is formed of a plurality of elongated, outwardly concave, side-by-side flutes extending generally parallel to the central axis of the side wall, each flute being defined laterally on each side by an elongated outwardly convex rib;

outermost convex ribs of each panel lie on the cylindrical envelope of the side wall of the can body and, at least in the longitudinal middle region of the panels, the remaining convex ribs of each panel lie inside the cylindrical envelope of the side wall;

each panel curves progressively along an inner peripheral portion in a radially inward direction from opposite outermost convex ribs thereof toward the cylindrical envelope central axis;

and the perimeter dimension of said side wall and the circumference of said cylindrical envelope of the side wall are substantially constant at any position along substantially an entire axial length of the side wall.

2. The open-topped can body as claimed in claim 1, wherein the said remaining convex ribs lie substantially on a chord of the cylindrical envelope of the side wall.

3. The open-topped can body as claimed in claim 1, wherein each panel is separated circumferentially from adjacent panels by a part cylindrical wall portion connecting the cylindrical portions of the side wall.

4. The open-topped can body as claimed in claim 1, wherein the panels are contiguous.

5. The open-topped can body as claimed in claim 1, wherein the ends of the panels have a substantially elliptical outline.

6. The open-topped can body as claimed in claim 1, in which the number of panels is in the range from 4 to 12.

7. The open-topped can body as claimed in claim 1 in which, at their greatest width, the panels occupy at least 70% of the circumference of the can body.

8. The open-topped can body as claimed in claim 1, wherein each panel has a number of flutes in the range from 2 to 8.

9. The open-topped can body as claimed in claim 1 in which, at their greatest width, the flutes occupy at least 70% of the circumferential extent of each panel.

10. The open-topped can body as claimed in claim 1, wherein the panels are equispaced around the circumference of the can body and all the panels are identical.

11. An open-topped sheet metal can body comprising an end wall and a tubular side wall upstanding from a periphery of the end wall, the side wall being formed from a plain cylinder defining a cylindrical envelope of the side wall;

said side wall terminating in an open top remote from said end wall;

said tubular side wall includes a plurality of flexible panels recessed within the cylindrical envelope of the side wall, all said panels being substantially equally spaced from each other in all circumferential directions around said side wall, each of said panels having a central longitudinal axis which extends in a direction generally parallel to an axis central to the cylindrical envelope of the side wall, each panel being connected at each of panel ends thereof to a cylindrical portion of the side wall;

each panel is formed of a plurality of elongated, outwardly concave, side-by-side flutes extending generally parallel to the central axis of the side wall, each flute being defined laterally on each side by an elongated outwardly convex rib;

outermost convex ribs of each panel lie on the cylindrical envelope of the side wall of the can body and, at least in the longitudinal middle region of the panels, the remaining convex ribs of each panel lie inside the cylindrical envelope of the side wall;

ends of adjacent flutes being circumferentially spaced from each other by an end of an intervening convex rib;

and the perimeter dimension of said side wall and the circumference of said cylindrical envelope of the side wall are substantially constant at any position along substantially an entire axial length of the side wall.

12. An open-topped sheet metal can body comprising an end wall and a tubular side wall upstanding from a periphery of the end wall, the side wall being formed from a plain cylinder defining a cylindrical envelope of the side wall;

said side wall terminating in an open top remote from said end wall;

said tubular side wall includes a plurality of flexible panels recessed within the cylindrical envelope of the side wall, all said panels being substantially equally spaced from each other in all circumferential directions around said side wall, each of said panels having a central longitudinal axis which extends in a direction generally parallel to an axis central to the cylindrical envelope of the side wall, each panel being connected at each of panel ends thereof to a cylindrical portion of the side wall;

each panel is formed of a plurality of elongated, outwardly concave, side-by-side flutes extending generally parallel to the central axis of the side wall, each flute being defined laterally on each side by an elongated outwardly convex rib;

outermost convex ribs of each panel lie on the cylindrical envelope of the side wall of the can body and, at least in the longitudinal middle region of the panels, the remaining convex ribs of each panel lie inside the cylindrical envelope of the side wall;

ends of all ribs terminate in said side wall cylindrical portions;

and the perimeter dimension of said side wall and the circumference of said cylindrical envelope of the side wall are substantially constant at any position along substantially an entire axial length of the side wall.

13. An open-topped sheet metal can body comprising an end wall and a tubular side wall upstanding from a periphery of the end wall, the side wall being formed from a plain cylinder defining a cylindrical envelope of the side wall;

said side wall terminating in an open top remote from said end wall;

said tubular side wall includes a plurality of flexible panels recessed within the cylindrical envelope of the side wall, all said panels being substantially equally spaced from each other in all circumferential directions around said side wall, each of said panels having a central longitudinal axis which extends in a direction generally parallel to an axis central to the cylindrical envelope of the side wall, each panel being connected at each of panel ends thereof to a cylindrical portion of the side wall;

each panel is formed of a plurality of elongated, outwardly concave, side-by-side flutes extending generally parallel to the central axis of the side wall, each flute being defined laterally on each side by an elongated outwardly convex rib;

outermost convex ribs of each panel lie on the cylindrical envelope of the side wall of the can body and, at least in the longitudinal middle region of the panels, the remaining convex ribs of each panel lie inside the cylindrical envelope of the side wall;

said flutes having converging ends which converge collectively toward each other in each panel;

and the perimeter dimension of said side wall and the circumference of said cylindrical envelope of the side wall are substantially constant at any position along substantially an entire axial length of the side wall.

14. The open-topped can body as claimed in claim 1 wherein ends of adjacent flutes are circumferentially spaced from each other by an end of an intervening convex rib.

15. The open-topped can body as claimed in claim 1 wherein ends of all ribs terminate in said side wall cylindrical portions.

16. The open-topped can body as claimed in claim 1 wherein said flutes have converging ends which converge collectively toward each other in each panel.

17. The open-topped can body as claimed in claim 11 wherein ends of adjacent flutes are circumferentially spaced from each other by an end of an intervening convex rib.

18. The open-topped can body as claimed in claim 11 wherein ends of all ribs terminate in said side wall cylindrical portions.

19. The open-topped can body as claimed in claim 11 wherein said flutes have converging ends which converge collectively toward each other in each panel.

20. The open-topped can body as claimed in claim 12 wherein ends of adjacent flutes are circumferentially spaced from each other by an end of an intervening convex rib.

21. The open-topped can body as claimed in claim 12 wherein ends of all ribs terminate in said side wall cylindrical portions.

22. The open-topped can body as claimed in claim 12 wherein said flutes have converging ends which converge collectively toward each other in each panel.

23. The open-topped can body as claimed in claim 13 wherein ends of adjacent flutes are circumferentially spaced from each other by an end of an intervening convex rib.

24. The open-topped can body as claimed in claim 13 wherein ends of all ribs terminate in said side wall cylindrical portions.

25. The open-topped can body as claimed in claim 13 wherein said flutes have converging ends which converge collectively toward each other in each panel.

* * * * *